US010544767B2

(12) United States Patent
Schroeder et al.

(10) Patent No.: US 10,544,767 B2
(45) Date of Patent: Jan. 28, 2020

(54) FUEL INJECTOR ASSEMBLY HAVING A CASE DESIGNED FOR SOLENOID COOLING

(71) Applicant: Caterpillar Inc., Deerfield, IL (US)

(72) Inventors: Eric L. Schroeder, Germantown Hills, IL (US); Craig P. Hittle, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/953,752

(22) Filed: Apr. 16, 2018

(65) Prior Publication Data

US 2019/0316557 A1 Oct. 17, 2019

(51) Int. Cl.

| | |
|---|---|
| ***F02M 53/04*** | (2006.01) |
| ***F01P 3/16*** | (2006.01) |
| ***F02F 1/24*** | (2006.01) |
| ***F02M 63/00*** | (2006.01) |
| ***F02M 31/00*** | (2006.01) |

(52) U.S. Cl.

CPC ..... *F02M 53/043* (2013.01); *F01P 3/16* (2013.01); *F02F 1/242* (2013.01); *F02M 31/00* (2013.01); *F02M 63/0017* (2013.01)

(58) Field of Classification Search

CPC .. F02M 53/043; F02M 63/0017; F02M 31/00; F01P 3/16; F02F 1/242

USPC ..... 123/541; 239/132.3

See application file for complete search history.

(56) References Cited

U.S. PATENT DOCUMENTS

| | | | | |
|---|---|---|---|---|
| 3,737,100 | A | 6/1973 | Chalmers | |
| 4,351,480 | A | 9/1982 | Nissan | |
| 5,397,055 | A * | 3/1995 | Paul | F02M 47/027 239/124 |
| 6,098,903 | A * | 8/2000 | Touvelle | F02M 51/005 239/585.1 |
| 8,074,903 | B2 | 12/2011 | Caterpillar | |
| 8,434,457 | B2 | 5/2013 | Caterpillar | |
| 9,341,153 | B2 | 5/2016 | Caterpillar | |
| 9,976,527 | B1 * | 5/2018 | Campion | F02M 53/043 |
| 2004/0211394 | A1 * | 10/2004 | Yager | F02M 53/043 123/468 |
| 2006/0016176 | A1 * | 1/2006 | Hilden | F01N 3/0253 60/286 |
| 2009/0302130 | A1 * | 12/2009 | Venkataraghavan | F02M 53/04 239/132 |

OTHER PUBLICATIONS

U.S. Appl. No. 15/405,925, entitled "Fuel Injector Assembly Having Sleeve for Directing Fuel Flow", by CAMPION, filed Jan. 13, 2017, 24 pages.

* cited by examiner

*Primary Examiner* — Mahmoud Gimie

(74) *Attorney, Agent, or Firm* — Harrity & Harrity

(57) ABSTRACT

A fuel injector assembly is disclosed. The fuel injector assembly may include a case that encloses a solenoid assembly. The fuel injector assembly may include one or more inlet passages, positioned on the case, to permit fluid to enter the case to cool the solenoid assembly. The fuel injector assembly may include one or more outlet passages, positioned on the case, to permit fluid to exit the case. The fuel injector assembly may include an annular protrusion positioned around a circumference of the case between the one or more inlet passages and the one or more outlet passages.

20 Claims, 3 Drawing Sheets

FUEL INJECTOR ASSEMBLY HAVING A CASE DESIGNED FOR SOLENOID COOLING

TECHNICAL FIELD

The present disclosure relates generally to fuel injectors and, more particularly, to a fuel injector assembly having a case designed for solenoid cooling.

BACKGROUND

A fuel injector may be used to inject fuel into an internal combustion engine by atomizing the fuel under high pressure and injecting the atomized fuel into a combustion chamber of the engine through a nozzle of the fuel injector. Some fuel injectors include a solenoid used to control the fuel injection, which generates heat during operation. The solenoid may be located in the middle of the body of the fuel injector, and cooling the solenoid may be difficult, particularly when the engine is operating at high speeds and high injection pressures. Heat may also be generated in the fuel injector due to spilled hot fuel, internal leaking of the fuel injector, and/or the like.

Cooling the solenoid and/or other components inside the fuel injector may be even more difficult if the fuel injector is seated in a unit cylinder head (where each cylinder of the engine has a single corresponding cylinder head) because low pressure cooling fuel may flow in parallel through each cylinder head along a fuel rail (e.g., a fuel supply and drain rail, a fuel supply and return rail, and/or the like). In this configuration, each successive fuel injector along the fuel rail may experience less fuel flow and/or hotter cooling fuel, which reduces cooling efficiency. Furthermore, if the fuel supply inlet and the fuel return outlet are positioned on the same side of a fuel injector, then the cooling fuel may flow from the fuel supply to the fuel return without passing through the fuel injector case and/or without cooling the solenoid.

One attempt to improve cooling of fuel injector solenoids is disclosed in U.S. Pat. No. 8,434,457 that issued to Coldren et al. on May 7, 2013 ("the '457 patent"). In particular, the '457 patent discloses a fuel injection system that provides a greater balance in the operating temperatures of the fuel injectors by providing a lower cooling rate for fuel injectors disposed upstream on the fuel rail and a higher cooling rate for fuel injectors disposed downstream on the fuel rail. Such cooling rates may be provided by manipulating the size of the slots or openings in the nozzle cases of the fuel injectors, and/or manipulating the flow rate of fuel supplied to an injectors as coolant flows between the nozzle case and solenoid assembly.

While the fuel injection system of the '457 patent may provide a greater balance in the operating temperatures of the fuel injectors along a fuel rail, there may still be cooling inefficiencies for each individual fuel injector. The fuel injector of the present disclosure solves one or more of the problems set forth above and/or other problems in the art.

SUMMARY

In one aspect, the present disclosure is related to a fuel injector assembly. The fuel injector assembly may include a case that encloses a solenoid assembly. The fuel injector assembly may include one or more inlet passages, positioned on the case, to permit fluid to enter the case to cool the solenoid assembly. The fuel injector assembly may include one or more outlet passages, positioned on the case, to permit fluid to exit the case. The fuel injector assembly may include an annular protrusion positioned around a circumference of the case between the one or more inlet passages and the one or more outlet passages.

In another aspect, the present disclosure is related to a fuel injection system. The fuel injection system may be for a cylinder head having one or more injector bores, a fuel supply passage, and a fuel drain passage. The fuel injection system may include one or more fuel injectors to be seated in the one or more injector bores. A fuel injector, of the one or more fuel injectors, may include a case that encloses one or more components. The fuel injector may include an inlet passage, positioned on the case, to permit fluid to enter the case to cool the one or more components. The fuel injector may include an outlet passage, positioned on the case, to permit fluid to exit the case. The fuel injector may include an annular protrusion positioned around a circumference of the case between the inlet passage and the outlet passage.

In yet another aspect, the present disclosure is related to an engine. The engine may include a cylinder head having one or more injector bores, a fuel supply passage, and a fuel drain passage. The engine may include a fuel injection system comprising one or more fuel injectors to be seated in the one or more injector bores. A fuel injector, of the one or more fuel injectors, may include a case that encloses a solenoid. The fuel injector may include an inlet passage, positioned on the case, to permit fluid to enter the case to cool the solenoid. The fuel injector may include an outlet passage, positioned on the case, to permit fluid to exit the case. The fuel injector may include an annular protrusion positioned around a circumference of the case between the inlet passage and the outlet passage such that an outer edge of the annular protrusion is positioned to be in closer proximity to an injector bore, in which the fuel injector is to be seated, than a first portion of the case that includes the inlet passage and a second portion of the case that includes the outlet passage.

DETAILED DESCRIPTION

This disclosure relates to a fuel injector. The fuel injector has universal applicability to any machine utilizing such a fuel injector, such as any machine with an engine that uses fuel injection. The term "machine" may refer to any machine that performs an operation associated with an industry such as, for example, mining, construction, farming, transportation, marine applications, or any other industry. As some examples, the machine may be an electric generator, a vehicle, a backhoe loader, a cold planer, a wheel loader, a compactor, a feller buncher, a forest machine, a forwarder, a harvester, an excavator, an industrial loader, a knuckle-boom loader, a material handler, a motor grader, a pipelayer, a road reclaimer, a skid steer loader, a skidder, a telehandler, a tractor, a dozer, a tractor scraper, a boat, a ship, or other paving, marine, or underground mining equipment.

Figure 1:
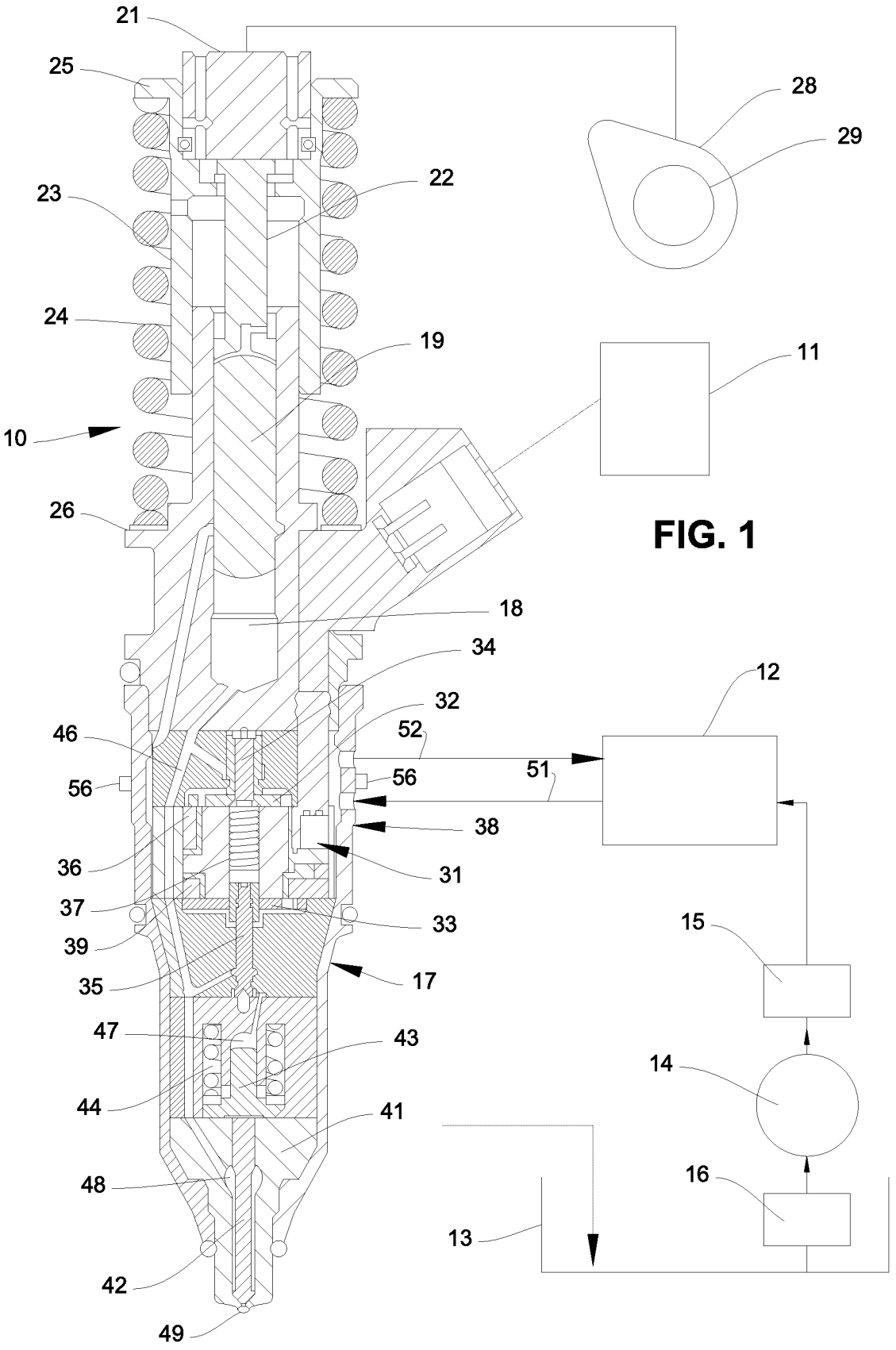
FIG. 1 is a diagram of an example fuel injector.

FIG. 1 is a diagram of an example fuel injector 10, sometimes referred to herein as a fuel injector assembly. In some implementations, the fuel injector 10 may be mechanically actuated and electronically controlled (e.g., an electronically controlled unit injector, a mechanical electronic unit injector (MEUI), and/or the like). For example, the fuel injector 10 may be linked to an engine control module (ECM) 11 or another type of controller. The fuel injector 10 may be in fluid communication with a fuel rail 12, such as a low pressure fuel supply and drain passage, a high pressure common rail (HPCR), and/or the like. The fuel rail 12 may draw fuel from a fuel tank 13 by way of a pump 14. The fuel may pass through one or more fuel filters 15, 16 before reaching the fuel injector 10. The fuel may enter the fuel injector 10 from a fuel supply passage 51, and may exit the fuel injector to a fuel drain passage 52.

While the fuel injector 10 of FIG. 1 is shown as being configured to receive fuel from a fuel supply passage 51 positioned on a same side of the fuel injector 10 as the fuel drain passage 52, in some implementations, the fuel supply passage 51 and the fuel drain passage 52 may be positioned on different sides of the fuel injector 10. Furthermore, while the fuel injector 10 of FIG. 1 is shown as being configured to receive fuel from a fuel supply passage 51 positioned at a different vertical level as the fuel drain passage 52, in some implementations, the fuel supply passage 51 and the fuel drain passage 52 may be positioned at the same vertical level. As described in more detail elsewhere herein, an annular protrusion 56 may be positioned around a circumference of the case 38 between the fuel supply passage 51 and the fuel drain passage 52.

The fuel injector 10 may include a fuel injector body 17 that includes a fuel pressurization chamber 18. A plunger 19 may be slideably disposed within the fuel pressurization chamber 18, and may be connected to a tappet 21 by a shaft or link 22. The tappet 21 may be coupled to or disposed within a tappet guide 23. A compression spring 24 may be trapped between a flange 25 of the tappet guide 23 and a corresponding fixed flange or shoulder 26 of the fuel injector body 17. The tappet 21, compression spring 24, and plunger 19 move upward and downward (in the orientation of FIG. 1) in response to a rotating action of a cam lobe 28 and an associated camshaft 29.

The fuel injector body 17 may house a solenoid assembly 31 (sometimes referred to herein as a solenoid) that includes an upper armature 32 and a lower armature 33. The upper armature 32 may control the movement of a spill valve 34, and the lower armature 33 may control the movement of a control valve 35. An upper solenoid coil 36 may correspond to the upper armature 32, and a lower solenoid coil 39 may correspond to the lower armature 33. An armature spring 37 biases the spill valve 34 and the control valve 35 into a relaxed position or a fill position.

The fuel injector 10 includes a nozzle 41 that accommodates a needle valve 42, which includes discharge orifices, one of which can be seen at 49. A control piston 43 is biased in the downward direction by a spring 44, which biases the needle valve 42 downward into the closed position shown in FIG. 1. A case 38 (e.g., a nozzle case) may accommodate and/or house the nozzle 41 and a lower portion of the fuel injector body 17 including the solenoid assembly 31.

With both springs 37, 44 in a relaxed position, the fuel injector 10 may be filled with fuel from the fuel rail 12 (e.g., via the supply passage 51) as the tappet 21 moves upward. After rotation of the cam lobe 28 causes the tappet 21 and plunger 19 to move downward to pressurize the fuel in the fuel pressurization chamber 18, the ECM 11 may activate the upper solenoid coil 36 to draw the upper armature 32 and spill valve 34 downward against the bias of the armature spring 37, thereby allowing pressurized fuel to pass through a high pressure fuel passage 46 toward a lower chamber 48 and the needle valve 42.

The ECM 11 may then activate the lower solenoid coil 39, raising the lower armature 33 and control valve 35 upward against the bias of the armature spring 37. This action releases pressure in a chamber 47 generated by activating the spill valve 34, thereby allowing the pressurized fuel in the lower chamber 48 to overcome the bias of the spring 44, thereby causing the needle valve 42 to move upwards and fuel to be injected through the orifice 49. When the injection is complete, the solenoid assembly 31 deactivates the lower armature 33 (e.g., via the lower solenoid coil 39) followed by a deactivation or lowering of the upper armature 32 by the solenoid assembly 31 (e.g., via the upper solenoid coil 36), which is controlled by the ECM 11.

As indicated above, FIG. 1 is provided as an example. Other examples are possible and may differ from what was described with regard to FIG. 1.

Figure 2:
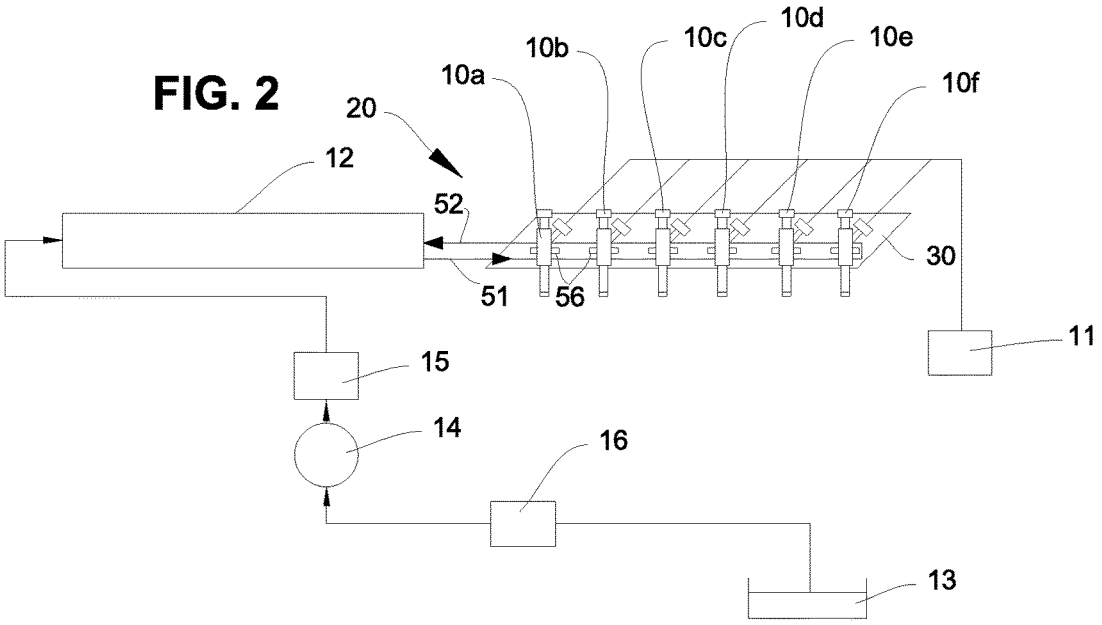
FIG. 2 is a diagram of an example fuel injection system that includes multiple fuel injectors linked in series.

FIG. 2 is a diagram of an example fuel injection system 20 that includes multiple fuel injectors 10 linked in series.

In FIG. 2, a fuel injection system 20 is illustrated with six fuel injectors 10*a* through 10*f* as an example. The six fuel injectors 10*a*-10*f* are connected in series to a fuel rail 12 of a cylinder head 30 (e.g., see FIG. 3). Each injector 10*a*-10*f* may be linked to the ECM 11. Fuel used to cool the injectors 10*a*-10*f* is supplied by a fuel supply passage 51 and is drained by a fuel drain passage 52. As described in more detail elsewhere herein, an annular protrusion 56 may be positioned around a circumference of a case 38 of a fuel injector 10 between the fuel supply passage 51 and the fuel drain passage 52.

As indicated above, FIG. 2 is provided as an example. Other examples are possible and may differ from what was described with regard to FIG. 2.

Figure 3:
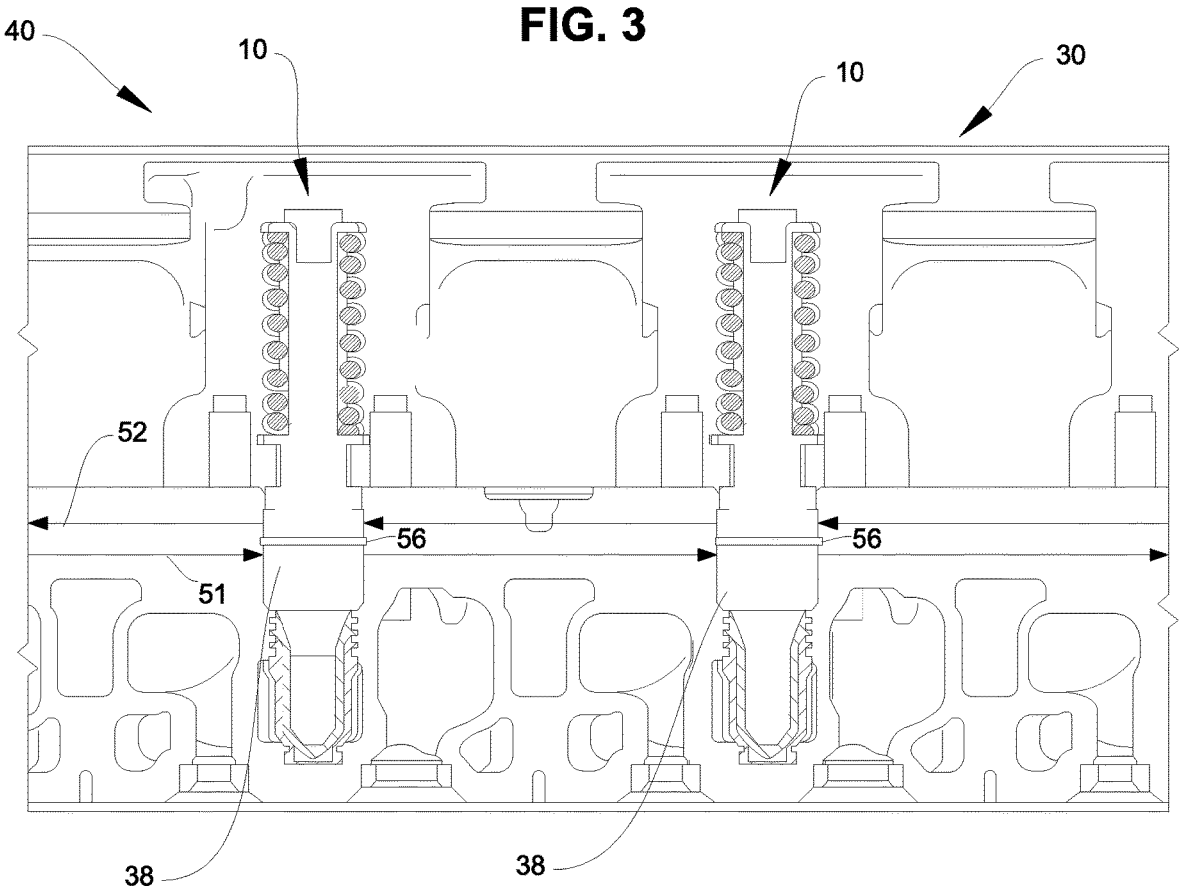
FIG. 3 is a diagram of a partial view of an engine, which shows two fuel injectors, a cylinder head, and a fuel supply passage and a fuel drain passage through the cylinder head.

FIG. 3 is a diagram of a partial view of an engine 40, which shows two fuel injectors 10, a cylinder head 30, and a supply passage 51 and a drain passage 52 passing through the cylinder head. FIG. 3 schematically illustrates an example position of the supply passage 51 and the drain passage 52 relative to the two fuel injectors 10 in the cylinder head 30. Fuel flowing through the supply passage 51 and the drain passage 52 may engage the case 38 of each fuel injector 10. As described in more detail elsewhere herein, an annular protrusion 56 may be positioned around a circumference of the case 38 between the fuel supply passage 51 and the fuel drain passage 52.

As indicated above, FIG. 3 is provided as an example. Other examples are possible and may differ from what was described with regard to FIG. 3.

Figure 4:
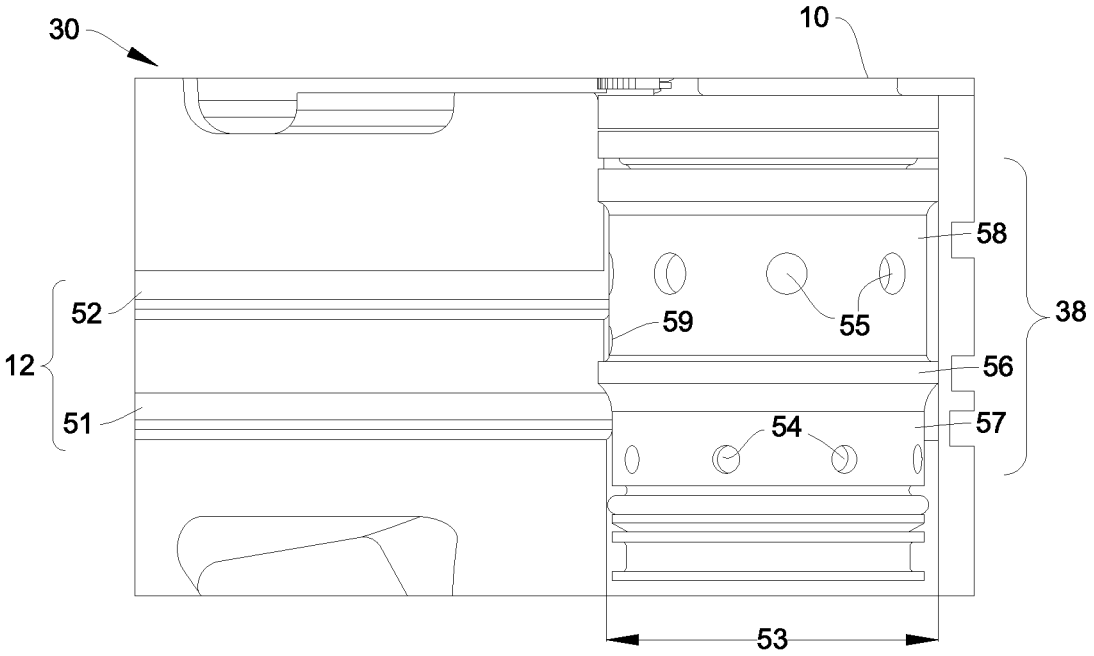
FIG. 4 is a diagram of an enlarged portion of FIG. 3 showing an example fuel injector case designed for cooling a solenoid in a fuel injector.

FIG. 4 is a diagram of an enlarged portion of FIG. 3 showing an example fuel injector case 38 designed for cooling a solenoid assembly 31 in a fuel injector 10 (e.g., a solenoid assembly 31 enclosed by the case 38). The fuel injector 10 may be seated in an injector bore 53 of a cylinder head 30. The fuel injector 10 may be supplied with fuel via a fuel supply passage 51 disposed within the cylinder head 30, and may drain fuel via a fuel drain passage 52. In some implementations, the cylinder head 30 is a unit cylinder head that encloses a single cylinder of the engine 40.

Although the fuel injector 10 of FIG. 4 is shown as being configured to receive fuel from a fuel supply passage 51 positioned on the same side of the fuel injector 10 and/or the injector bore 53 as the fuel drain passage 52, in some implementations, the fuel supply passage 51 and the fuel drain passage 52 may be positioned on different sides of the fuel injector 10 and/or the injector bore 53. Furthermore, while the fuel injector 10 of FIG. 4 is shown as being configured to receive fuel from a fuel supply passage 51 positioned at a different vertical level than the fuel drain passage 52 (e.g., with respect to the fuel injector 10 and/or the injector bore 53), in some implementations, the fuel supply passage 51 and the fuel drain passage 52 may be positioned at substantially the same vertical level (e.g., within a tolerance limit).

As shown, the fuel injector case 38 may include one or more inlet passages 54 (e.g., holes or passageways through the case 38). The inlet passage(s) 54 may be positioned on the case 38 to permit fluid to enter the case 38 to cool the solenoid assembly 31. In some implementations, the case 38 may include multiple inlet passages 54, and every inlet passage 54, of the multiple inlet passages 54, may be substantially the same size (e.g., within a tolerance limit), thereby reducing machining costs as compared to machining inlet passages having different sizes. In some implementations, the inlet passage(s) 54 may be used to receive fuel to be consumed by the fuel injector 10. Additionally, or alternatively, the inlet passage(s) 54 may be used to receive fuel to cool components internal to the fuel injector 10 (e.g., the solenoid assembly 31 and/or the like).

As further shown, the fuel injector case 38 may include one or more outlet passages 55 (e.g., holes or passageways through the case 38). The outlet passage(s) 55 may be positioned on the case 38 to permit fluid to exit the case 38. In some implementations, the case 38 may include multiple outlet passages 55, and every outlet passage 55, of the multiple outlet passages 55, may be substantially the same size (e.g., within a tolerance limit), thereby reducing machining costs as compared to machining outlet passages having different sizes. In some implementations, a size of each inlet passage 54 may be less than or equal to a size of each outlet passage 55 so as to more evenly distribute the supply fuel entering through the inlet passages 54.

As further shown, the fuel injector case 38 may include an annular protrusion 56 (e.g., a lip, a bump, a step, a feature, and/or the like). The annular protrusion 56 may be positioned around a circumference of the case 38 between the one or more inlet passages 54 and the one or more outlet passages 55 so as to prevent fuel from flowing from the supply passage 51 to the drain passage 52 without entering the case 38 and cooling the solenoid 31 (or to reduce an amount of fuel that flows from the supply passage 51 to the drain passage 52 without entering the case 38). For example, an outer edge of the annular protrusion 56 (e.g., an edge furthest from the case 38) may be positioned to be in closer proximity to the injector bore 53 (e.g., a wall of the injector bore 53) than a first portion 57 of the case 38 that includes the inlet passage(s) 54 and a second portion 58 of the case 38 that includes the outlet passage(s) 55. As shown, the annular protrusion 56 may be positioned between the first portion 57 of the case 38 and the second portion 58 of the case 38.

In some implementations, the annular protrusion 56 may include a seal (e.g., an O-ring, a seal band, a metal seal band, a polymer seal band, and/or the like) seated in a groove positioned around the circumference of the case 38. In some implementations, the annular protrusion 56 is affixed to the case 38 (e.g., via welding, screwing, bolting, and/or the like). In some implementations, the annular protrusion 56 is integrated into the case 38. For example, the case 38 and/or the fuel injector 10 may be machined to create the annular protrusion 56 on the case 38. In some implementations, the annular protrusion 56 may consist of the same material as the case 38 (e.g., metal and/or the like).

In some implementations, the fuel injector case 38 may include a spill passage 59 (e.g., a hole or passageway through the case 38, different from the outlet passage(s) 55) to permit excess fuel to exit the fuel injector 10. As shown, the annular protrusion 56 may be positioned between the one or more inlet passages 54 and the spill passage 59 so as to prevent hot fuel, that spills out of the spill passage 59, from reentering the case 38.

As indicated above, FIG. 4 is provided as an example. Other examples are possible and may differ from what was described with regard to FIG. 4.

INDUSTRIAL APPLICABILITY

The disclosed fuel injector 10 may be used with any engine 40 that uses fuel injection, such as an internal combustion engine, a diesel engine, a direct injection engine, an engine of a machine, and/or the like. During operation, the fuel injector 10 may generate heat by operation of a solenoid assembly 31, spilling of hot fuel, internal leakage of the fuel injector 10, and/or the like. The disclosed fuel injector 10 may assist with dissipating such heat and may improve cooling performance of a solenoid assembly 31 housed by the fuel injector 10 and/or other components housed by the fuel injector 10 by directing coolant into a case 38 of the fuel injector 10 by means of the annular protrusion 56, preventing coolant from bypassing the solenoid assembly 31 and flowing directly from the supply passage 51 to the drain passage 52 without entering the case 38, reducing an amount of coolant that flows directly from the supply passage 51 to the drain passage 52 without entering the case 38, and/or the like. By improving cooling performance of the solenoid assembly 31 and/or other components of the fuel injector 10, the engine 40 may operate more efficiently with a longer life span.

In some implementations, the disclosed fuel injector 10 may be seated in a unit cylinder head 30, and fuel may flow in parallel through adjacent cylinder heads 30 via a fuel rail 12. In this case, each fuel injector 10 along the fuel rail 12 may see reduced cooling efficiency as compared to the previous fuel injector 10 along the fuel rail 12. The case 38 with the annular protrusion 56 disclosed herein may improve the cooling efficiency of all fuel injectors 10 along the fuel rail 12.

In some implementations, the cylinder head 30 may be designed with the fuel supply passage 51 and the fuel drain passage 52 on the same side of an injector bore 53 in the cylinder head 30, which may reduce a packaging and/or design cost of the cylinder head 30, particularly when the cylinder head 30 is a unit cylinder head 30 that caps a single cylinder. However, this design may increase the likelihood that fuel flows directly from the fuel supply passage 51 to the fuel drain passage 52 (e.g., by way of the injector bore 53) without entering the case 38 and cooling components housed in the case 38, such as the solenoid assembly 31. The disclosed case 38 having the annular protrusion 56 increases cooling efficiency by preventing or reducing such direct fuel flow from the fuel supply passage 51 to the fuel drain passage 52.

As used herein, the articles "a" and "an" are intended to include one or more items, and may be used interchangeably with "one or more." Also, as used herein, the terms "has,"

"have," "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations are possible in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of possible implementations. Although each dependent claim listed below may directly depend on only one claim, the disclosure of possible implementations includes each dependent claim in combination with every other claim in the claim set.

What is claimed is:

1. A fuel injector assembly, comprising:

a case that encloses a solenoid assembly, the case including:

a first portion that includes multiple inlet passages that permit fluid to enter the case to cool the solenoid assembly;

a second portion that includes multiple outlet passages that permit fluid to exit the case; and an annular protrusion positioned around a circumference of the case between the first portion and the second portion.

2. The fuel injector assembly of claim 1, wherein the annular protrusion is positioned between the multiple inlet passages and a spill passage on the case, wherein the spill passage is different from the multiple outlet passages.

3. The fuel injector assembly of claim 1, wherein the annular protrusion includes a seal seated in a groove positioned around the circumference of the case between the multiple inlet passages and the multiple outlet passages.

4. The fuel injector assembly of claim 1, wherein the annular protrusion is affixed to the case.

5. The fuel injector assembly of claim 1, wherein the annular protrusion is integrated into the case.

6. The fuel injector assembly of claim 1, wherein a size of each inlet passage, of the multiple inlet passages, is less than or equal to a size of each outlet passage of the multiple outlet passages.

7. The fuel injector assembly of claim 1, wherein every inlet passage, of the multiple inlet passages, is substantially a same size.

8. The fuel injector assembly of claim 1, wherein every outlet passage, of the multiple outlet passages, is substantially a same size.

9. A fuel injection system for a cylinder head having one or more injector bores, a fuel supply passage, and a fuel drain passage, the fuel injection system comprising:

one or more fuel injectors to be seated in the one or more injector bores, wherein a fuel injector, of the one or more fuel injectors, comprises:

a case that encloses one or more components, the case including:

a first portion that includes multiple inlet passages to permit fluid to enter the case to cool the one or more components;

a second portion that includes multiple outlet passages to permit fluid to exit the case; and an annular protrusion positioned around a circumference of the case between the first portion and the second portion.

10. The fuel injection system of claim 9, wherein the annular protrusion includes at least one of a seal, a feature affixed to the case, or a feature integrated into the case.

11. The fuel injection system of claim 9, wherein an outer edge of the annular protrusion is positioned to be in closer proximity to an injector bore, in which the fuel injector is to be seated, than the first portion and the second portion.

12. The fuel injection system of claim 9, wherein the fuel supply passage and the fuel drain passage are positioned at different vertical levels with respect to an injector bore, of the one or more injector bores, in which the fuel injector is to be seated.

13. The fuel injection system of claim 9, wherein the fuel supply passage and the fuel drain passage are positioned at substantially a same vertical level with respect to an injector bore, of the one or more injector bores, in which the fuel injector is to be seated.

14. The fuel injection system of claim 9, wherein the fuel supply passage and the fuel drain passage are positioned on different sides of an injector bore, of the one or more injector bores, in which the fuel injector is to be seated.

15. The fuel injection system of claim 9, wherein the fuel supply passage and the fuel drain passage are positioned on a same side of an injector bore, of the one or more injector bores, in which the fuel injector is to be seated.

16. The fuel injection system of claim 9, wherein the cylinder head is a unit cylinder head for a single cylinder.

17. An engine, comprising:

a cylinder head having one or more injector bores, a fuel supply passage, and a fuel drain passage;

a fuel injection system comprising one or more fuel injectors to be seated in the one or more injector bores, wherein a fuel injector, of the one or more fuel injectors, comprises:

a case that encloses a solenoid, the case including:

a first portion that includes multiple inlet passages to permit fluid to enter the case to cool the solenoid;

a second portion that includes multiple outlet passages to permit fluid to exit the case; and an annular protrusion positioned around a circumference of the case between the first portion and the second portion such that an outer edge of the annular protrusion is positioned to be in closer proximity to an injector bore, in which the fuel injector is to be seated, than the first and the second portion.

18. The engine of claim 17, wherein the annular protrusion includes at least one of a seal, a feature affixed to the case, or a feature integrated into the case.

19. The engine of claim 17, wherein the fuel injector is configured to consume fuel received via at least one inlet passage of the multiple inlet passages.

20. The engine of claim 17, wherein the fuel supply passage and the fuel drain passage are positioned on at least one of:

a same side of the injector bore, or different vertical levels with respect to the injector bore.

* * * * *